United States Patent [19]

Raymond

[11] 4,011,887

[45] Mar. 15, 1977

[54] FLUID POWER CONTROL APPARATUS

[75] Inventor: Robert E. Raymond, Zanesville, Ohio

[73] Assignee: R. E. Raymond Co. Inc., Zanesville, Ohio

[22] Filed: Feb. 23, 1976

[21] Appl. No.: 660,332

[52] U.S. Cl. ..... 137/608

[51] Int. Cl.[2] ..... F15B 13/02

[58] Field of Search ..... 137/271, 561 R, 561 A, 137/454.6, 608; 251/367

[56] References Cited

UNITED STATES PATENTS 3,891,003 6/1975 Duttarer et al. ..... 137/608 X

*Primary Examiner*—Alan Cohan
*Assistant Examiner*—Gerald A. Michalsky
*Attorney, Agent, or Firm*—Cennamo; Kremblas; Foster

[57] ABSTRACT

A fluid power control apparatus which comprises the unique combination of a control housing including a cylindrically shaped core member mounted in a sealed relationship within a receptacle member. A plurality of grooves or recesses generated in the outer wall surface of the core member define selected fluid path connections in axial and circumferential directions to radial passages formed in the core and receptacle members to communicate valve elements in the core or receptacle members to one another and to external means in almost any selected manner. This combination forms in a relatively simple and dramatically compact manner any preselected simple or complex fluid control circuit in a single package.

12 Claims, 7 Drawing Figures

FLUID POWER CONTROL APPARATUS

BACKGROUND

Throughout the evolution of the application of fluid power principles to do useful and controlled work, a general pattern of component and circuit design has prevailed since the beginning of the use of fluid power to the present.

Generally speaking, a limited number of fluid operative elements, such as spools, poppets and the like, have been packaged in separate housing as distinct and elementary functional devices commonly referred to as valves and valve packages which are then interconnected by pipes or tubes and the like, to form fluid circuits.

In the last couple of decades, an emphasis has been directed to elimination of some piping through the use of various manifold techniques which proved cumbersome but did eliminate some interconnecting piping requirements.

The known manifolding techniques still require complex machining, drilling cross-cut bores and difficult seal problems.

In any case, the net result of the prior art today still leaves the industry with no satisfactory solution to the problems of complex and very expensive connection methods which employ an excessive amount of metal and require very expensive manufacturing costs to accomplish a fluid control circuit still employing individual elementary valve packages.

Therefore, fluid power design philosophy is far behind the modern design philosophy of the electronic science as applied to control techniques. In addition to a possible lack of appreciation of the fundamentals of control science, the committment to a design philosophy of a multiplicity of separate and distinct housings for elementary valving functions and the very expensive and bulky connection and packaging means employed, is a barrier to dramatically improving the state of control and use of fluid power.

For example, it is not all uncommon for the housing costs to far exceed the operating elements cost. If more than one element is incorporated in a valve housing, a maze of complex cross drilling and machining is inherently required.

The use of manifold techniques as practiced today is much more involved than is readily appreciated. First a considerable amount of metal is required. Additionally major costs of machining, sealing, bolting and the like, are involved to accomodate the individual valves. Further, major and very difficult drilling and machining are involved in the internal circuit conduits necessary to form the desired connections in the manifold.

In view of the state of the art, it can be fairly said that only relatively insignificant design improvements in construction costs and in advanced control potential have been accomplished over the years.

There has been an overwhelming and yet unfulfilled need for a simple and low cost means for accomplishing the interconnecting function between operating elements or whole valve functions which eliminate the mass of metal and costly manufacturing techniques required by prior art methods and means.

SUMMARY OF INVENTION

The present invention relates generally to fluid control apparatus and particularly to a novel means for providing a simple and low cost control package complete with all required internal connections and operative valve functions.

In general, the present invention provides a control housing which includes a core member and a receptacle member. The core member is preferably cylindrically shaped and is provided with a pattern of grooves or recesses and is mounted in the receptacle member provided with an opening having inner wall surfaces conforming to the outer wall surfaces of the core member to form a sealed relationship between the confronting surfaces. The grooves then form fluid paths in axial and circumferential directions and are communicated by radially extending passages in the receptacle and core members to operative valve elements disposed in the core or receptacle members.

The almost unlimited variety of interconnections possible between the fluid paths and valve elements permits a wide choice of circuit design to be accomplished in a simple and comparatively inexpensive manner.

Further, multiple core members may be employed in a single receptacle member to form control subcircuits or several concentrically disposed core members may be utilized wherein an adjoining receptacle member also functions as a core member and is retained within a second receptacle member.

OBJECTS

It is a primary object of the present invention to provide a novel fluid control apparatus which features a unique approach to fluid circuit design in a much less costly and more compact manner compared to the prior art.

It is another object of the present invention to provide a fluid control apparatus which employs a core member having a continuously curved surface, such as a cylinder, enclosed within a receptacle member wherein all necessary fluid paths and interconnections can be accomplished utilizing simplified manufacturing techniques and less material to dramatically reduce cost.

It is another object to provide an apparatus of the type described wherein a very dramatic size reduction is realized as compared to an equivalent control circuit design employing prior art methods and means.

It is another object of the present invention to provide an apparatus of the type described which dramatically enlarges the scope of sophistication of the control parameters in designing fluid power circuitry to accomplish given objectives.

It is still another object of the present invention to provide an apparatus of the type described which is basically universal in flexibility and adaptability to present and future needs in the fluid power industry.

It is a further object of the present invention to provide an apparatus of the type described which incorporates all of the above mentioned features and additionally lends itself to a broad potential for a high degree of standardization of valve elements and circuit connecting parts which leads to a further reduction in manufacturing costs.

IN THE DRAWINGS

DETAILED DESCRIPTION

Figure 1:
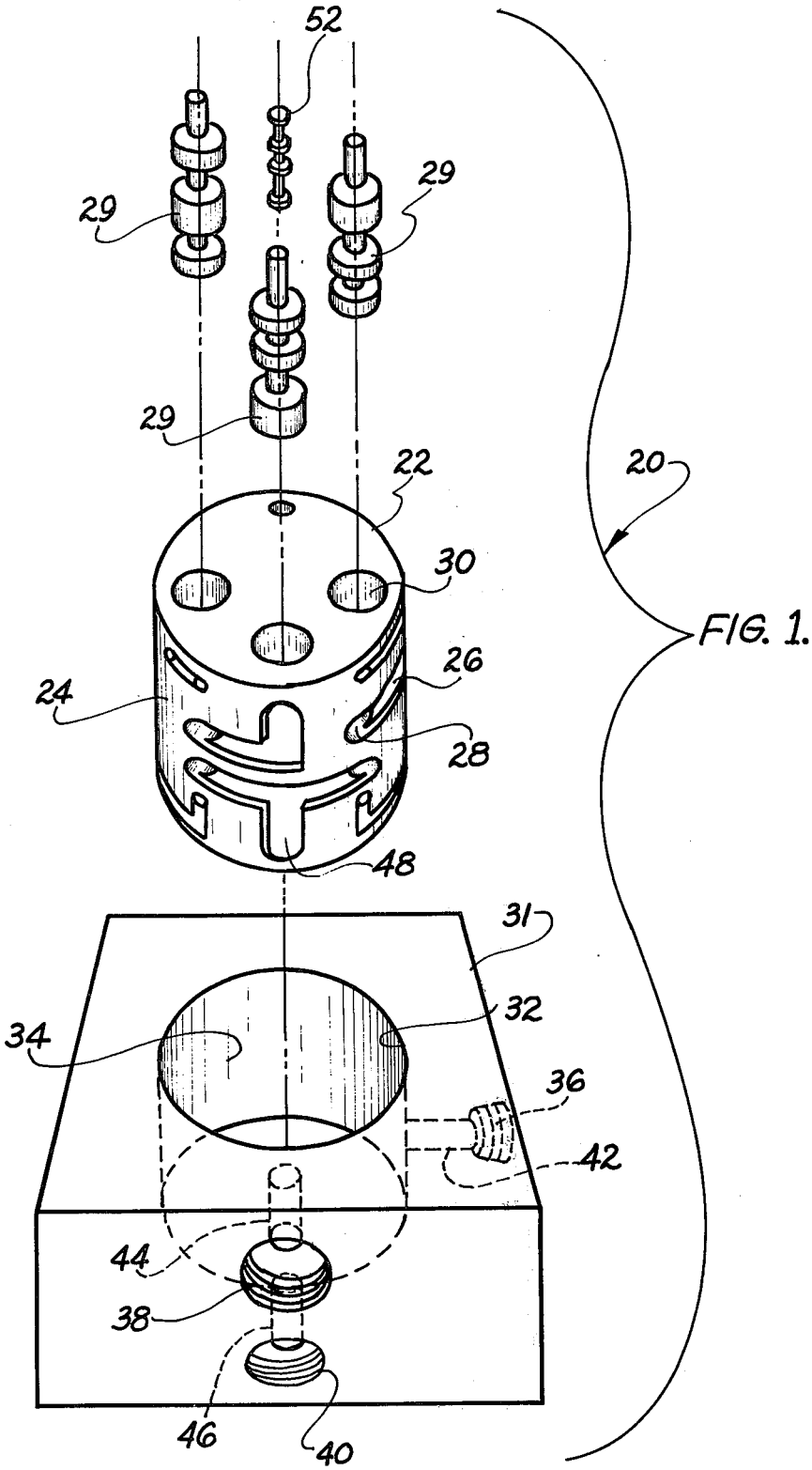
FIG. 1 is an exploded perspective view of an apparatus constructed in accordance with the present invention.

A fluid power control apparatus constructed in accordance with the present invention is illustrated in FIG. 1 and includes a housing means indicated generally at 20.

Housing means 20 includes a central core member 22 having a continuously curved and, preferably a closed continuously curved outer wall surface 24. The preferred configuration for core member 22 is cylindrical.

A plurality of grooves or recesses such as at 26 are generated in any suitable manner on the outer wall surface 24 is any predetermined pattern representing desired paths for fluid communication in an axial or circumferential direction or to include a component in both directions. These paths may be interconnected with each other directly or via radially extending passages in core member 22, such as at 28.

It should be readily appreciated that grooves 26 may be generated by standard techniques such as machining or casting in metal and additionally by a die melting technique if a plastic material is employed.

In the embodiment shown in FIG. 1, for illustrative purposes only, four spool valve elements 29 are shown which are mounted in a respective axially aligned bore 30 provided in core member 22 and communicated to specific grooves 26 via radial passages, such as 28.

Other forms of fluid control valving elements may be employed as desired without departing from the spirit of the present invention. Additionally, whole valve functions in separate housings may be employed with or without the operative valve elements being mounted in either the core member 22 or the receptacle member 31 while still taking advantage of the low cost and relative ease of generating a complex interconnecting circuit via the core-receptacle relationship as disclosed herein.

However, in the preferred form, the most advantageous construction and utilization of the principles of the present invention are believed to be available by incorporating the operative control functions within as compact a package as possible. Therefore, in most instances, the simplest approach is to incorporate the valve elements within the core or receptacle members as will become more evident and more fully described later herein.

Housing means 20 also includes a receptacle member 31 which is provided with an opening 32 having a substantially identical configuration as core 22. Upon mounting core 22 within opening 32 in a fixed and sealed relationship, each of the grooves 26 become distinct fluid paths in a fluid circuit which is integrally formed and self-contained in housing means 20.

In view of the configuration of the curved surfaces defined by outer wall surface 24 and the inner wall surfaces 34 of opening 32, a press fit or shrink fit may be employed to form the required sealed relationship. A lining of a suitable material, such as plastic may also be employed, if deemed necessary, to assure the sealed relationship necessary to maintain the integrity of the fluid paths 26.

It should be noted that the preferred configuration of core 22 is cylindrical in view of the relative ease of generating the required fit in cylindrical opening 32 and the standard manufacturing techniques which may be employed to generate the grooves and axial or radial drillings to form the circuit connections.

However, it should be pointed out that another advantage of the teachings of the present invention is to employ configurations as described and claimed wherein the core may be enclosed in the outer receptacle member in preferably a self-retaining manner, or at the least a substantially self-retaining manner, to reduce and preferably eliminate the bolting or welding of the separate components together.

Since the core and receptacle member should remain in a fixed angular relationship to one another, a key or dowel pin may be employed to assure that the desired angular relationship is maintained.

It is recognized that in a fluid power circuit, high pressure is generated for many applications which would tend to force apart individual components of the housing. The use of a configuration as generally taught herein provide an outer receptacle member surrounding the core member in a substantially self-retaining relationship which resists the outward forces generated by the fluid pressure such that the outer member is continuously in tension. This provides a construction wherein the difficult sealing problems commonly encountered in present manifolding techniques is substantially eliminated.

In a conventional manner, inlet and outlet ports such as at 36, 38 and 40 and associated passages such as at 42, 44 and 46 may be easily formed in receptacle member 31 to communicate the particular fluid control circuit to external fluid power elements such as pump, tank, actuator or other control functions if desired.

Once core member 22 is inserted into opening 32 and the valve elements 29 are operatively inserted into bores 30, an end cap member may be fixed over the top of core 22 to hold the valve element assembly in position and provides the desired adjustment or bias housing required for a given control function.

Figure 2:
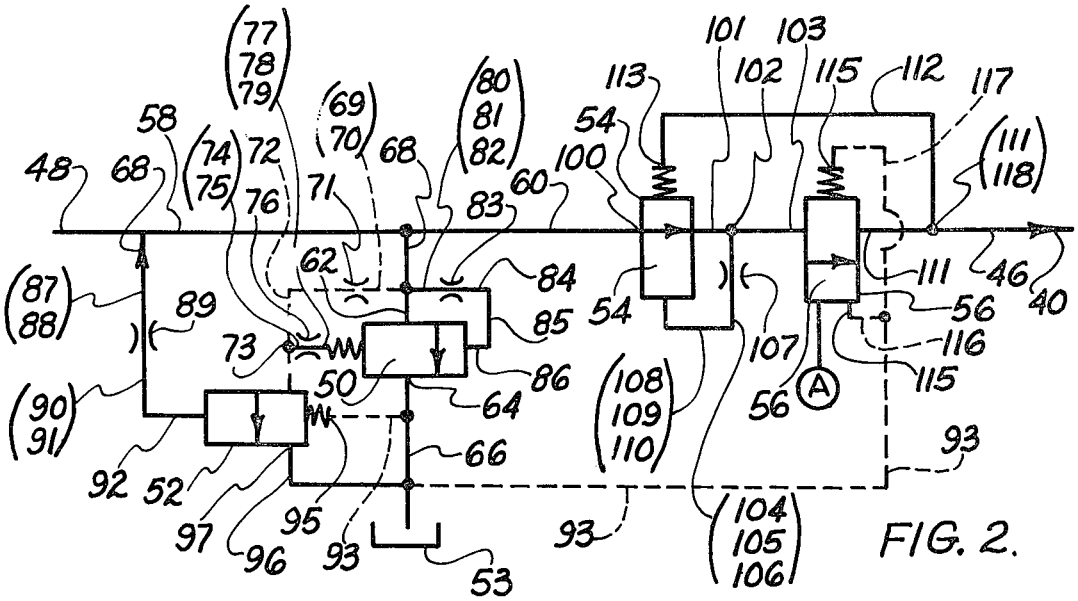
FIG. 2 is a schematic view of a typical fluid circuit.
Figure 3:
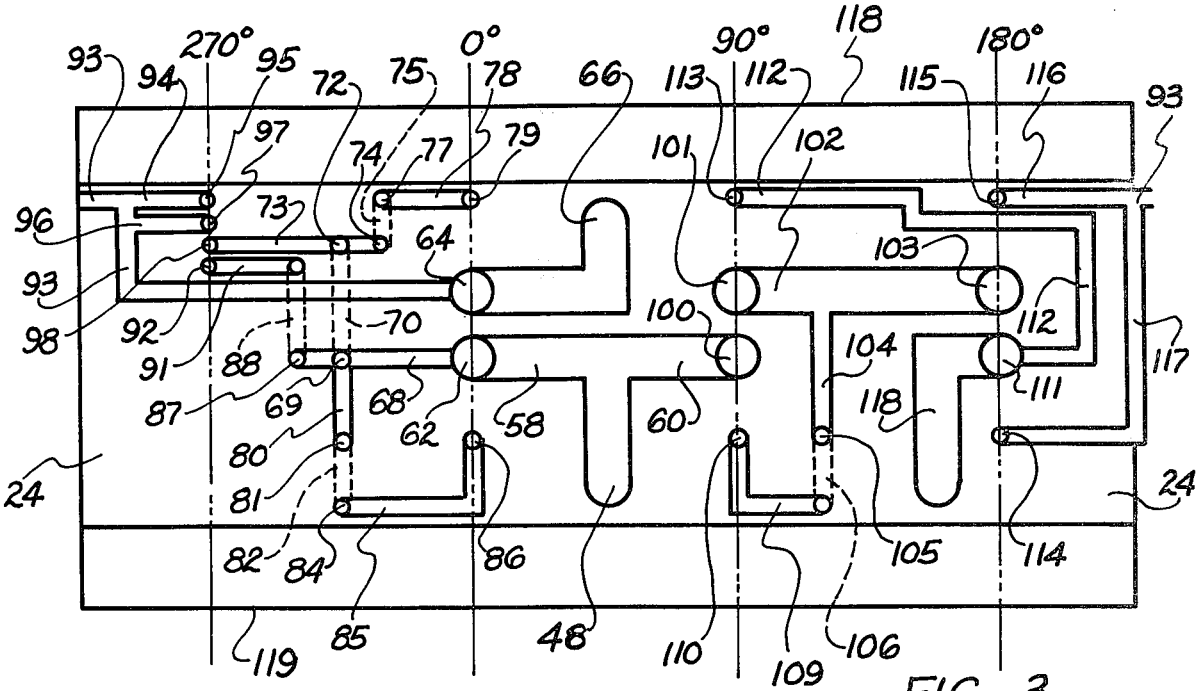
FIG. 3 is a diagrammatic representation of the circuit pathways formed on a portion of the apparatus of the present invention in accordance therewith to form the fluid circuit illustrated in FIG.. 2.
Figure 4:
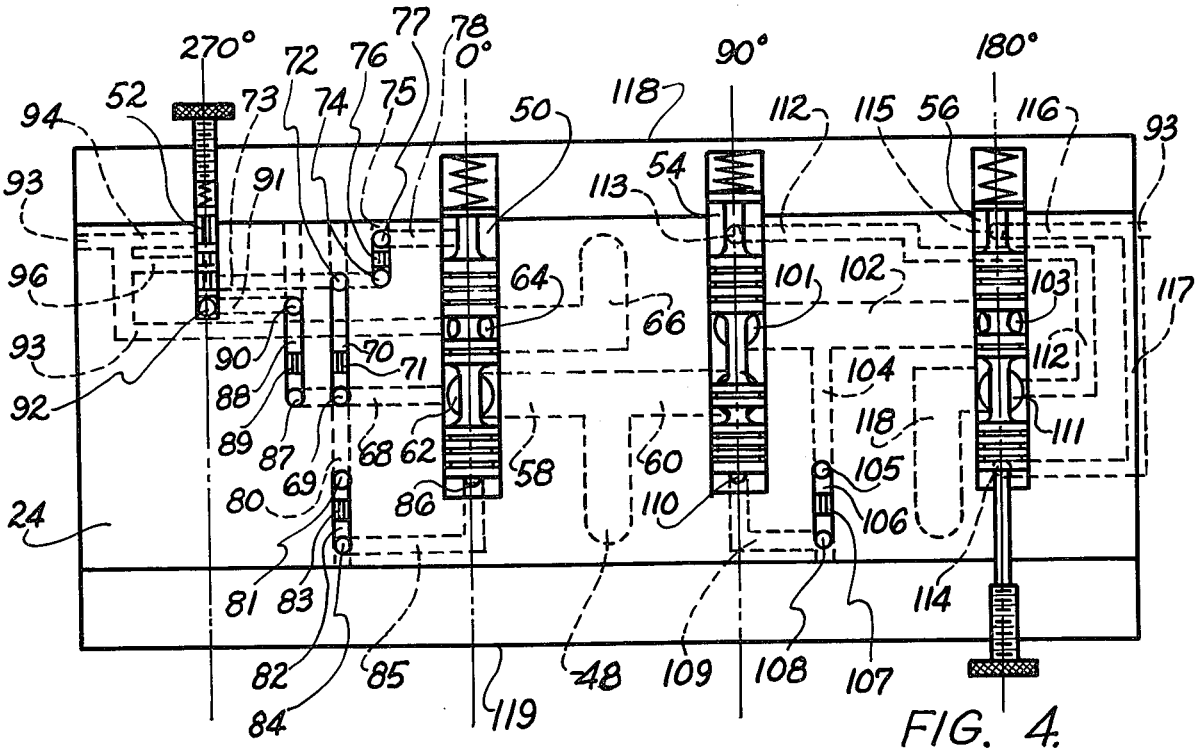
FIG. 4 is a diagrammatic representation similar to FIG. 3 additionally showing the valve means and their relationship to the pathways which would be operative to perform the valve functions in accordance with the circuit illustrated in FIG. 2.
Figure 5:
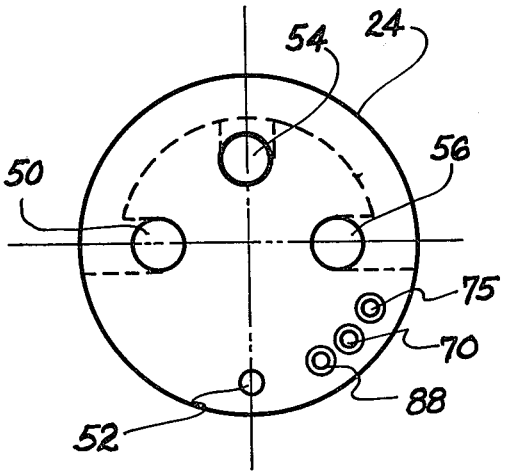
FIG. 5 is a top view of the apparatus shown in FIG. 1.
Figure 6:
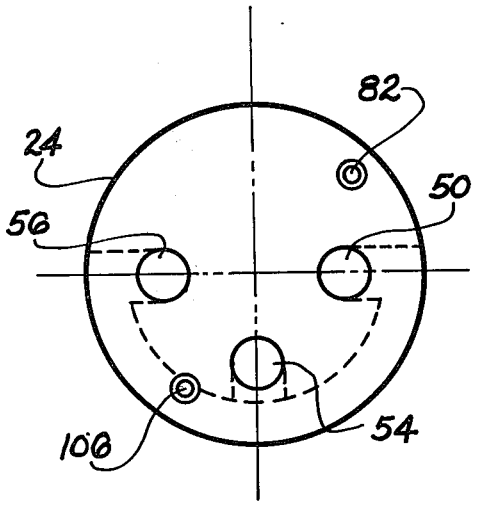
FIG. 6 is a bottom view of the apparatus shown in FIG. 1.

For purposes of illustration, and a feature which aids in circuit design, a schematic view of the circuit interconnections of the control apparatus of FIG. 1 is illustrated in FIGS. 3 and 4 with a typical schematic diagram of the same circuit illustrated in FIG. 2 for comparison purposes.

It should be pointed out that for illustrative purposes and for ease of description, FIG. 3 represents the outer surface of core member 22 in a planar manner and FIG. 4 is a schematic view in that the various valve elements are shown superimposed in solid lines over the planar view of outer surface 24 or core 22. For descriptive purposes, the fluid paths and passages are shown as dotted lines in FIG. 4. However, the interconnecting functional relationship between fluid paths, passages and ports, and valve elements are maintained to indicate their interconnecting purposes.

The circuit shown in FIG. 2 represents a relatively common fluid power control circuit employing pressure relief and flow control functions.

As seen in FIG. 2, the main pressure relief valve 50 is operatively connected to a pilot spool valve 52 and to tank 53.

Inlet pressure is also communicated to a flow compensator spool 54 and to a flow sensor spool 56 which functions as an adjustable orifice in the example described herein.

Now referring to FIGS. 3 and 4,, the various paths and passages which form the interconnections between the operative valve elements will be pointed out solely to illustrate the general principal of the present invention. The basic function of the valve elements and the purposes of the circuit are well-known to one skilled in the art and form no part of the present invention, in and of itself, except for illustrative purposes.

Additionally, for purposes of clarity and only for ease of description, the grooves or recesses formed on the outer wall will be referred to as fluid paths herein as opposed to the radially or axially directed holes which will be referred to as passages. Also, it should be understood that the terms radial or axial include a direction which has either a radial or axial component.

As viewed in FIGS. 3 and 4, inlet pressure from port 40 and passage 46 of receptacle 31 is communicated to inlet path 48 and then to a common fluid path having legs 58 and 60. Path 58 communicates with the pressure relief portion of the circuit and path 60 communicates with the flow control portion of the circuit with each circuit portion being related to each other via paths 58 and 60.

Pressure relief spool 50 is connected to inlet path 58, via radial passage 62 and to tank via radial passage 64 and fluid path 66 which outlets through receptacle passage 44 and outlet port 38.

The bias end of spool 50 is connected to fluid path 58 via fluid path 68, radial passage 69, axial passage 70 which is provided with a control orifice 71, radial passage 72, fluid path 73, radial passage 74, axial passage 75 which contains a damping orifice 76, radial passage 77, fluid path 78, and radial passage 79.

The opposing end of spool 50 is communicated to the inlet pressure from path 58 via path 68, path 80, radial passage 81, axial passage 82 which is provided with a damping orifice 83, radial passage 84, fluid path 85, and radial passage 86.

The circuit associated with pilot spool 52 is communicated to inlet pressure in path 58 and path 68 via radial passage 87, axial passage 88 which contains a damping orifice 89, radial passage 90, fluid path 91 and radial passage 92 which communicates with the lower end of spool 52. The bias end of spool 52 is communicated to tank via path 66, paths 93 and 94 and radial passage 95. Outlet flow from spool 52 is also communicated to path 93 via path 96 and radial passage 97.

Spool 52 is also communicated to inlet pressure and to the bias side of spool 50 via radial passage 98 which communicates with fluid path 73.

The flow control portion of the circuit communicates with the pressure relief control portion via the common inlet pressure path 60 which in turn, communicates with radial passage 100 which is ported to flow compensator spool 54.

Compensator spool 54 communicates with the inlet of flow sensor spool 56 via radial passage 101, fluid path 102 and radial passage 103.

Path 102 is also communicated to the lower end of compensator spool 54 through fluid path 104, radial passage 105, axial passage 106 which is provided with a damping orifice 107, radial passage 108, fluid path 109 and radial passage 110.

Outlet flow from sensor spool 56 is communicated to the bias end of spool 54 via radial passage 111, fluid path 112 and radial passage 113.

The bias side of sensor spool 56 as well as the opposing side are connected via radial passages 114 and 115 and fluid paths 116 and 117 which in turn, are connected to fluid path 93.

Outlet flow from sensor spool 56 is also communicated to outlet port passage 42 and outlet port 36 in receptacle 31 via radial passage 111 and fluid path 118.

A detailed description of the operation of the fluid circuit is not believed necessary, however, it should be noted that the various interconnections described with respect to FIGS. 3 and 4 are noted in FIG. 2. In some instances, the various paths and passages shown in FIGS. 3 and 4 are indicated as only one schematic line and therefore more than one reference numeral is bracketed in FIG. 2 to indicate the common communication of the particular paths and passages involved.

Of significant importance in the sample circuit shown, is the realization of the fact that the whole internal circuit is formed utilizing the peripheral grooves for axial and circumferential paths and radial and axially generated passages to complete the various connections in the manner indicated.

It should be readily recognized that the grooves, such as 26, in FIG. 1 may be generated in a conventional manner by straight forward milling or casting techniques in a relatively low cost manner.

The radial and axial passages may be drilled in a relatively simple manner, in view of the cylindrical configuration. This is particularly true compared to the cross drilling at complex angles usually encountered in manifolding techniques practices at the present time or the complex casting techniques required in present methods of generating internal passages.

Further, axial valve openings, such as 30 in FIG. 1, are the only precision machining operation which is necessary for a suitable spool-bore fit. This, of course, is also true in conventional valve spool housings.

It should be pointed out that in the example described, the axial bores, such as 82 and 106, were utilized only to incorporate removably mounted orifices such as 83 and 107. The axial drilling can be provided with a threaded portion for the insertion of a suitably threaded insert. However, a functionally equivalent recess may be more easily provided in the formation of the peripheral grooves if desired. However, a orifice so formed would not be readily removably if it should become plugged.

Further, it should be recognized that many other design options are possible utilizing the principles of the present invention. For example, core 22 may be mounted in such a manner that it may be removable.

Cap members, such as top cap 118 and bottom cap 119 may be formed in any conventional manner. Details are not shown herein, such as suitable seals and plugs for the valve elements and the axials bores accomodating the various removably mounted orifices which require only standard and conventional techniques, well-known to those skilled in the art.

The cap members merely serve as a housing for the various bias springs or threaded adjustment screws.

Preferably, the cap members would be removably connected to the housing 20 in any suitable conventional manner for easy access to the valve elements as needed.

It becomes readily apparent from the above description that a tremendous savings in space and manufacturing cost becomes available for complex fluid power circuits. For example, the pressure relief-flow control package described herein may be incorporated in a cylindrical core having a diameter of 3.88 inches and a length of about 4.36 inches and accomodate a flow of approximately 30 gallons per minute. The receptacle member may have almost any outer dimension and configuration and need only provide sufficient wall thickness to function as a self-retaining, pressure-resisting outer boundary.

To further illustrate the magnitude of the advantages to be obtained employing the teachings of the present invention, one need only imagine a much more complex circuit which can be formed utilizing the same principles.

For example, only a relatively insignificant increase in size of the example described, such as a few inches in diameter will permit several more standard sized valve spools to be incorporated into core 22. Then the desired grooves and passages comprising a very complex interconnecting function may still be formed in a relatively simple manner compared to the prior art as presently practiced.

Further, for applications wherein space is a very important consideration, the core and receptacle could be much smaller and very small valve elements could be made to create a complex fluid power control package of such reduced size that new applications for industry are possible which heretofore were believed to be totally unattainable. In effect, practical micro-fluid power circuits are now available to the design engineer in view of the present invention.

In view of the foregoing description, it should be apparent that the present invention dramatically enhances the degree of sophistication of fluid power control design because prior cost and size barriers no longer act as practical limits to stifle design innovation.

Figure 7:
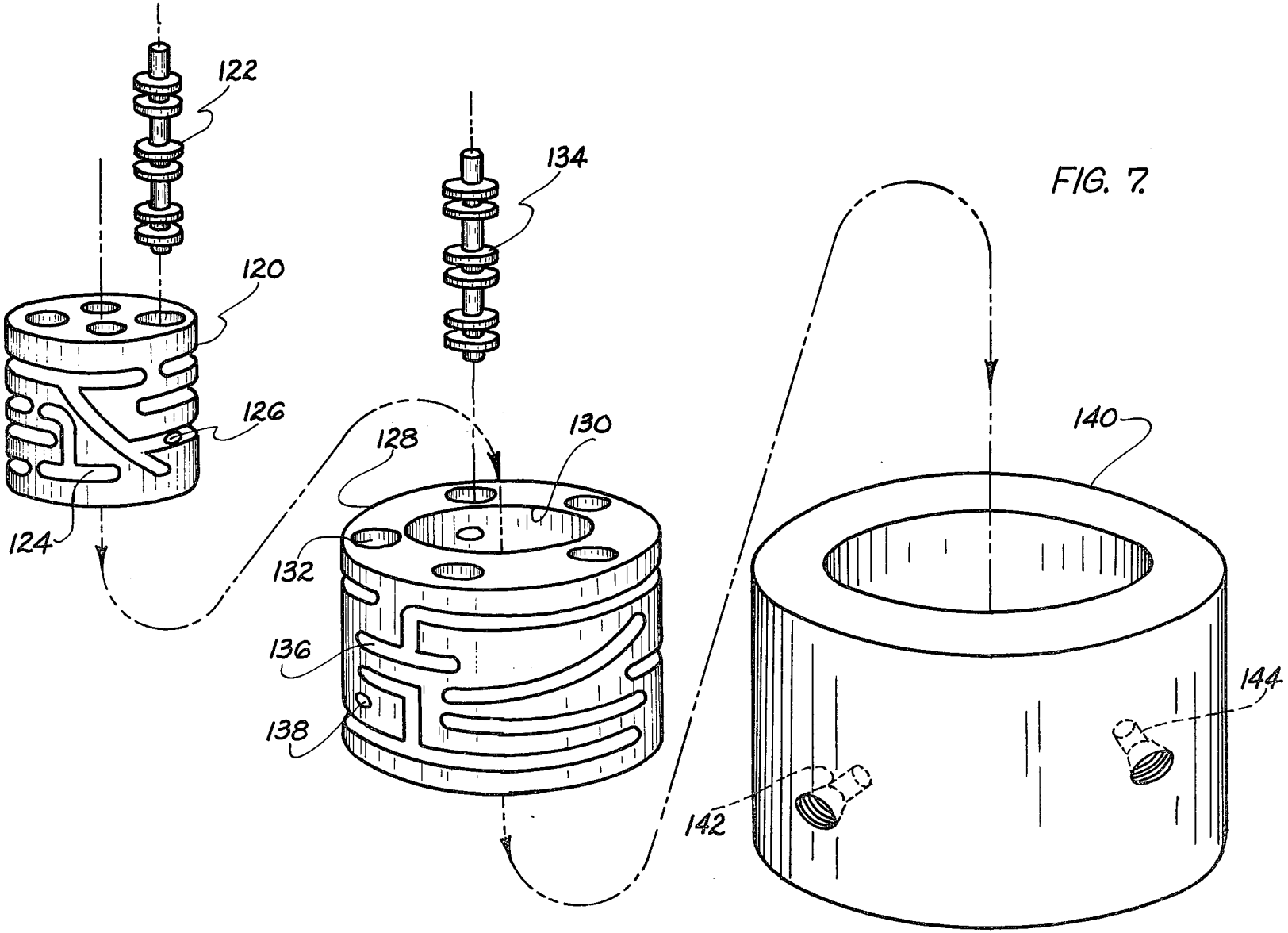
FIG. 7 is an exploded perspective view illustrating another embodiment of the present invention showing a multiple core and retaining member construction.

For example, FIG. 7 represents an illustration of the building block principle that may be used practicing the present invention.

A first core 120 may include four major valve elements such as 122, with corresponding circuit connections in the form of grooves, such as 124, and radial passages, such as 126.

Core 120 is then, press fit for example, in sealed relationship within a second member 128. Member 128 includes cylindrical opening 130 for receiving core 120 and includes several valve bores 132 which receive valve elements such as 134.

Again various circuits connections between the valve elements 134 are defined by grooves, such as 136 and radial passages 138. Further, a relationship between the valve functions in core 120 and in the core-receptacle member 128 may be interrelated as desired by selected radial passages.

Then a third member 140 functions as a receptacle for member 128 and is provided with appropriate inlet and outlet passages 142 and 144 for communication with a fluid power acuator, for example.

It can be readily appreciated that, if desired, this type of arrangement could be multiplied and a most sophisticated and complex fluid power control circuit could be manufactured utilizing relatively low cost techniques and minimum spacial relationships.

What is claimed is:

1. In a fluid power control apparatus, the combination of a control housing means comprising a core member having a closed continuously curved outer wall surface and a receptacle means provided with an opening, said core member being mounted in said opening in a sealed and fixed relationship between the outer wall surface of said core and the adjacently disposed inner wall surfaces defining said opening; a plurality of recesses formed in at least one of said adjacently disposed wall surfaces defining fluid paths between said wall means for communication of fluid in axial and circumferential directions; a plurality of passages in said housing means in communication with certain of said recesses for the communication of fluid to or away from said fluid paths formed between said wall means; valve means disposed in communication with said passages in said housing means to define a predetermined fluid circuit between said valve means, said passages and said fluid paths; and inlet and outlet port means in said housing means adapted for communicating said fluid circuit to external fluid power operative elements.

2. The control apparatus defined in claim 1 wherein said valve means includes at least one valve element disposed within said housing means.

3. The control apparatus defined in claim 2 wherein said valve element is disposed within said core member of said housing means and said core member includes radially directed valve port passages communicating said valve element with certain of said recesses forming said fluid paths between said wall means.

4. The control apparatus defined in claim 3 wherein said core member includes a plurality of axially disposed valve receiving openings and wherein a valve element is disposed in a respective one of said valve receiving openings.

5. The control apparatus defined in claim 4 wherein certain of said recesses defining said fluid paths are interconnected with one another and with certain of said valve port passages to define any preselected fluid circuit between said valve elements and fluid power operative elements disposed external to said housing means.

6. The control apparatus defined in claim 4 wherein said radially directed port passages are generated along radial lines extending into said core member in communication with selected valve receiving openings.

7. A fluid power control apparatus comprising, in combination, control housing means including at least one core member having a continuously curved outer wall surface and a receptacle member provided with at least one opening adapted to receive said core member in a fixed and sealed relationship between the curved outer wall surface of said core member and adjacently disposed inner wall surfaces of said opening; grooves formed in at least one of said wall surfaces to form a plurality of discrete fluid paths between said wall means for axial and circumferential communication of fluid between said wall means; a plurality of passage means formed in said housing means including port means communicating with certain of said fluid paths between said wall means for communicating fluid to or away from said fluid paths; valve elements disposed in said control housing communicating with certain of said port means to define a selected fluid control circuit; and inlet and outlet port means communicating with certain of said valve elements.

8. The fluid control apparatus defined in claim 7 wherein said fluid path formed between said wall means include fluid paths for the circumferential communcation of fluid, for the axial communication of fluid, and certain of said passage means having a component in both the axial and circumferential direction.

9. The fluid control apparatus defined in claim 7 wherein certain of said valve elements are disposed in said core member in axially aligned relationship and wherein said last-mentioned passage means are radially extending holes communicating with said axially aligned valve elements.

10. A fluid power control apparatus comprising, in combination, a housing means including a core member having a closed continuously curved outer wall surface mounted in an opening provided in a first receptacle member in a fixed and sealed relationship between the outer wall surface of said first core member and the adjoining inner wall surfaces defining said opening in said first receptacle member; grooves in at least one of said wall surfaces forming defined fluid paths between said wall surfaces for the communication of fluid in axial and circumferential directions; valve element means mounted in said first core member; passage means in said housing means communicating certain of said valve element means with certain of said fluid paths; inlet and outlet port means in said housing in communication with certain of said valve element means; said first receptacle member having a continuously curved outer wall surface and being mounted in an opening provided in a second receptacle member in a fixed and sealed relationship between the curved outer wall surface of said first receptacle member and the adjoining inner wall surfaces defining said opening in said second receptacle member; grooves in at least one of said adjoining wall surfaces of said first and second receptacle members forming defined fluid paths for the axial and circumferential communication of fluid between said adjoining wall surfaces; passage means in said first and second receptacle members communicating with certain of said fluid paths formed between said adjoining wall surfaces of said first and second receptacle members and with certain of said valve element means in said core member; and valve means communicating with certain of said passage means in a first and second receptacle members and with inlet and outlet ports in said first or second receptacle members adapted for communicating with fluid operative elements external to said second receptacle member.

11. In a fluid power control housing the combination of an inner member provided with a substantially continuously curved outer wall surface and an outer member mounted in substantially self-retaining and surrounding relationship to said inner member and provided with an inner wall surface in sealed relationship to said curved outer wall surface of said inner member, the wall means of said outer member defining said inner wall surface being continuously in tension to resist outward pressure generated between said curved outer wall surface of said inner member and the inner wall surface of said outer member; a plurality of grooves formed in at least one of said wall surfaces mounted in sealed relationship to one another to define distinct fluid paths for communicating fluid in axial and circumferential directions; radially extending passages formed in said inner or outer member for communicating fluid to or away from said grooves; and valve control means communicating with said passages to define a predetermined fluid circuit between said valve means, and inlet and outlet ports in said housing adapted for communicating said fluid circuit to external fluid power operative elements.

12. The apparatus defined in claim 11 wherein said inner member has a substantially cylindrical configuration.

* * * * *